US010164322B2

(12) United States Patent
de Jong et al.

(10) Patent No.: US 10,164,322 B2
(45) Date of Patent: Dec. 25, 2018

(54) SIGNAL TRANSMISSION SYSTEM FOR ELECTRONIC DEVICES

(71) Applicant: APPLE INC., Cupertino, CA (US)

(72) Inventors: Erik G. de Jong, Cupertino, CA (US); Dale N. Memering, Cupertino, CA (US); Jeffrey C. Mylvaganam, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 516 days.

(21) Appl. No.: 14/469,882

(22) Filed: Aug. 27, 2014

(65) Prior Publication Data

US 2016/0064800 A1 Mar. 3, 2016

(51) Int. Cl.

*H01Q 1/24* (2006.01)
*H01Q 1/27* (2006.01)
*H01Q 7/00* (2006.01)

(52) U.S. Cl.

CPC ..... *H01Q 1/243* (2013.01); *H01Q 1/273* (2013.01); *H01Q 7/00* (2013.01)

(58) Field of Classification Search

CPC ..... H01Q 1/24; H01Q 1/273; H01Q 7/00
USPC ..... 343/702
See application file for complete search history.

(56) References Cited

U.S. PATENT DOCUMENTS 4,673,936 A * 6/1987 Kotoh ..... G01S 1/68 342/385
5,699,319 A * 12/1997 Skrivervik ..... G04G 21/04 343/718
8,562,489 B2 * 10/2013 Burton ..... G04F 10/00 482/1
9,172,148 B2 * 10/2015 Lyons ..... H01Q 1/273
2003/0197648 A1 10/2003 Quinn et al.
2006/0111163 A1 5/2006 Oh
2007/0222691 A1 9/2007 Lee, IV et al.
2010/0331050 A1 12/2010 Tahk et al.
2012/0299841 A1 11/2012 Tang et al.
2014/0232609 A1 8/2014 Lee
2016/0062405 A1 * 3/2016 Mylvaganam ..... B23K 26/364 361/679.03
2016/0099497 A1 * 4/2016 Lee ..... H01Q 1/38 343/702
2016/0285157 A1 * 9/2016 Aizawa ..... H01Q 1/273

FOREIGN PATENT DOCUMENTS

CN 1202049 A 12/1998
CN 1707374 A 12/2005
CN 102428605 A 4/2012
(Continued)

*Primary Examiner* — Huedung Mancuso
(74) *Attorney, Agent, or Firm* — Michael H. Lyons

(57) ABSTRACT

An electronic device including a signal transmission system. The electronic device may include a housing, and a cover coupled to the housing and defining a groove formed in the cover. The electronic device may also include a signal transmission system positioned within the housing. The signal transmission system may include an antenna at least partially received within the groove formed in the cover. The antenna may have an antenna body, and a contact pad in electrical communication with the antenna body. The signal transmission system may also have a flexible member positioned adjacent the antenna body. The flexible member may contact the contact pad of the antenna.

20 Claims, 6 Drawing Sheets

(56) References Cited

FOREIGN PATENT DOCUMENTS

| | | | |
|---|---|---|---|
| CN | 103676631 | A | 3/2014 |
| EP | 0869576 | A1 | 10/1998 |
| EP | 1662605 | A1 | 5/2006 |

* cited by examiner

SIGNAL TRANSMISSION SYSTEM FOR ELECTRONIC DEVICES

TECHNICAL FIELD

The disclosure relates generally to electronic devices, and more particularly to a signal transmission system including an antenna positioned within a cover for an electronic device.

BACKGROUND

Electronic devices continue to become more prevalent in day-to-day activities. For example, smart phones, tablet computers and other electronic devices continue to grow in popularity and provide everyday personal and business functions to its users. As functionality increases, the need for more circuitry within electronic devices also increases. However, with increased functionality, it is also a desire for new electronic devices to decrease in both size and weight.

Although modern circuitry continues to shrink and require less space within an electronic device, the desire to reduce the size and weight of the electronic device continues to make the space within a housing of the electronic device limited. Additionally, with limited space within the housing, circuitry of the various components within the electronic device may interfere with the operation of each other, and may ultimately cause issues or total failure within the electronic device.

Typically, these electronic devices include cover glasses or other transparent layers that may protect a display of the device. In conventional electronic devices, the cover glass may be utilized to protect the display. In order to adequately protect the display, the cover glass may be substantially thick, and may occupy a large portion of the space within the housing and may take up a majority of the overall thickness of the electronic device. Although functional in protecting the display of the electronic device, the cover glass may be considered wasted space from the point of view of attempting to maximize circuitry within the electronic device while also minimizing the overall size and weight of the electronic device.

SUMMARY

Generally, embodiments discussed herein are related to a signal transmission system including an antenna positioned within a cover for an electronic device. Specifically, the majority of an antenna of a signal transmission system may be coupled to and positioned within a groove formed partially through a cover for an electronic device. By forming a groove within the cover of the electronic device, and subsequently positioning the majority of the antenna within the groove, the antenna of the signal transmission system may occupy a minimal amount of space within the housing of the electronic device. Additionally, the signal transmission system may include flexible members for forming electrical connections for the antenna. The flexible members may maintain an electrical connection with the antenna even when the antenna deforms or deflects as a result of a user applying a force to the cover of the electronic device.

One embodiment may include an electronic device including a housing, a cover coupled to the housing and defining a groove, and a signal transmission system positioned within the housing. The signal transmission system may include an antenna at least partially received within the groove. The antenna may have an antenna body, and a contact pad in electrical communication with the antenna body. The signal transmission system may also have a flexible member positioned adjacent the antenna body. The flexible member may contact the contact pad of the antenna.

Another embodiment may include a signal transmission system. The signal transmission system may include an antenna having a substantially circular loop portion and a flexible protrusion extending from a portion of the substantially circular loop portion. The antenna may also have a plurality of contact pads positioned on the flexible protrusion, where the contact pads are in electrical communication with the antenna. The signal transmission system may also include a plurality of flexible members contacting the plurality of contact pads.

A further embodiment may include a signal transmission system including an antenna housing. The antenna housing may include a substantially circular loop portion and a flexible protrusion extending from a portion of the substantially circular loop portion. The signal transmission system may also include a first contact pad positioned on the flexible protrusion of the housing, a second contact pad positioned on the flexible protrusion of the antenna housing adjacent the first contact pad, and an antenna wire positioned within the antenna housing. The antenna wire may have a first end in electronic communication with the first contact pad, and a second end, positioned opposite the first end, in electronic communication with the second contact pad. The signal transmission system may further include a first flexible member contacting the first contact pad, and a second flexible member positioned adjacent the first flexible member. The second flexible member may contact the second contact pad.

BRIEF DESCRIPTION OF THE DRAWINGS

The disclosure will be readily understood by the following detailed description in conjunction with the accompanying drawings, wherein like reference numerals designate like structural elements, and in which.

Figure 1:
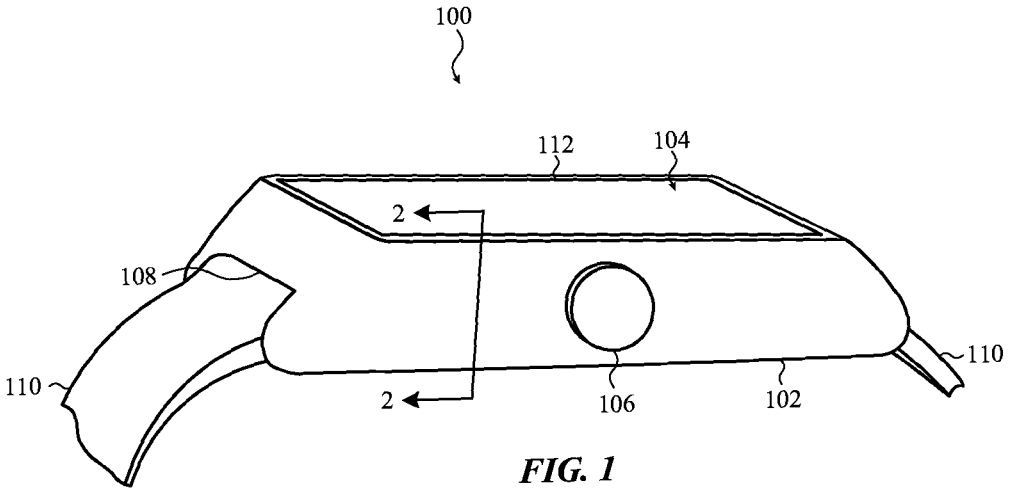
FIG. 1 depicts an illustrative perspective view of a wearable electronic device, according to embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, the disclosure covers alternatives, modifications, and equivalents as can be included within the spirit and scope of the described embodiments as defined by the appended claims.

The following disclosure relates generally to electronic devices, and more particularly to a signal transmission system including an antenna positioned within a cover for an electronic device.

All or the majority of an antenna of a signal transmission system may be positioned within and/or affixed to a groove formed partially through or within a cover for an electronic device. By forming a groove within the cover of the electronic device, and subsequently positioning the majority of the antenna within the groove, the antenna of the signal transmission system may occupy a reduced or minimal amount of space within the housing of the electronic device. Additionally, the signal transmission system may include flexible members for forming electrical connections for the antenna. The flexible members may maintain an electrical connection with the antenna even when the antenna moves, deforms or deflects as a result of a user applying a force to the cover of the electronic device.

These and other embodiments are discussed below with reference to FIGS. 1-6. However, those skilled in the art will readily appreciate that the description given herein with respect to these Figures is for explanatory purposes only and should not be construed as limiting.

FIG. 1 shows an illustrative perspective view of a portable or wearable electronic device 100 (hereafter, "electronic device"), according to embodiments. Electronic device 100, as shown in FIG. 1, may be configured to provide health-related information or data, such as, but not limited to, heart rate data, blood pressure data, temperature data, oxygen level data, diet/nutrition information, medical reminders, health-related tips or information, or other health-related data. The electronic device may optionally convey the health-related information to a separate electronic device, such as a tablet computing device, smart phone, personal digital assistant, computer, and so on. In addition, electronic device 100 may provide additional information, such as but not limited to, time, date, health, statuses or externally connected or communicating devices and/or software executing on such devices, messages, video, operating commands, and so forth (and may receive any of the foregoing from an external device), in addition to communications.

Electronic device 100 may include a housing 102 at least partially surrounding a display 104 and one or more buttons 106 or input devices. The housing 102 may form an outer surface, partial outer surface, and/or protective case for the internal components of electronic device 100, and may at least partially surround the display 104. The housing 102 may be formed of one or more components operably connected together, such as a front piece and a back piece. Alternatively, the housing 102 may be formed of a single piece operably connected to the display 104. Housing 102 may be formed from a plurality of distinct materials including, but not limited to, corundum, commonly referred to as sapphire, metal, glass or plastic. Additionally, housing 102 may include a decorative and/or coating layer that be disposed on the outer and/or inner surface of housing 102. The decorative layer and/or coating layer may be disposed on the surface(s) of housing 102 to protect the enclosure and/or provide a decorative feature (e.g., exterior color) for electronic device 100.

Housing 102 may also have recesses 108 formed on opposite ends to connect a wearable band 110 (partially shown in FIG. 1) to electronic device 100. Wearable band 110 may be used to secure wearable electronic device 100 to a user, or any other object capable of receiving electronic device 100. In a non-limiting example where electronic device 100 is a smart watch, wearable band 110 may secure the watch to a user's wrist. In other non-limiting examples, electronic device 100 may secure to or within another part of a user's body, or any suitable securement location, such as, but not limited to, a post, clothing, and the like.

Display 104 may be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology. A cover 112 may be positioned above the touchscreen of display 104. That is, and as discussed herein, cover 112 may be positioned above the touchscreen of display 104 and may be at least partially positioned within an opening of housing 102 and coupled to housing 102. Cover 112 may protect display 104 from contaminants, without obstructing a user's view and/or ability to interact with display 104 and/or electronic device 100. As such, cover 112 may be transparent or translucent, fully or partially, in certain embodiments. As discussed herein, cover 112 may be formed from corundum, and particularly sapphire. However, it is understood that cover 112 may be formed from any suitable transparent material and/or combination of suitable transparent material including, but not limited to, ceramics, alumina, chemically strengthened glass, and reinforced plastic.

Button 106 may include any conventional input/output (I/O) device for electronic device 100. Specifically, button 106 may include an actuation component in electronic and/or mechanical communication with the internal components of electronic device 100, to provide user input and/or allow the user to interact with the various functions of electronic device 100. In an embodiment, button 106 may be configured as a single component surrounded by housing 102. Alternatively, button 106 may include a plurality of components, including an actuation component, in mechanical/electrical communication with one another and/or with the internal components of electronic device 100. Button 110 may likewise include a sensor, such as a biometric sensor, touch sensor, or the like.

Figure 2:
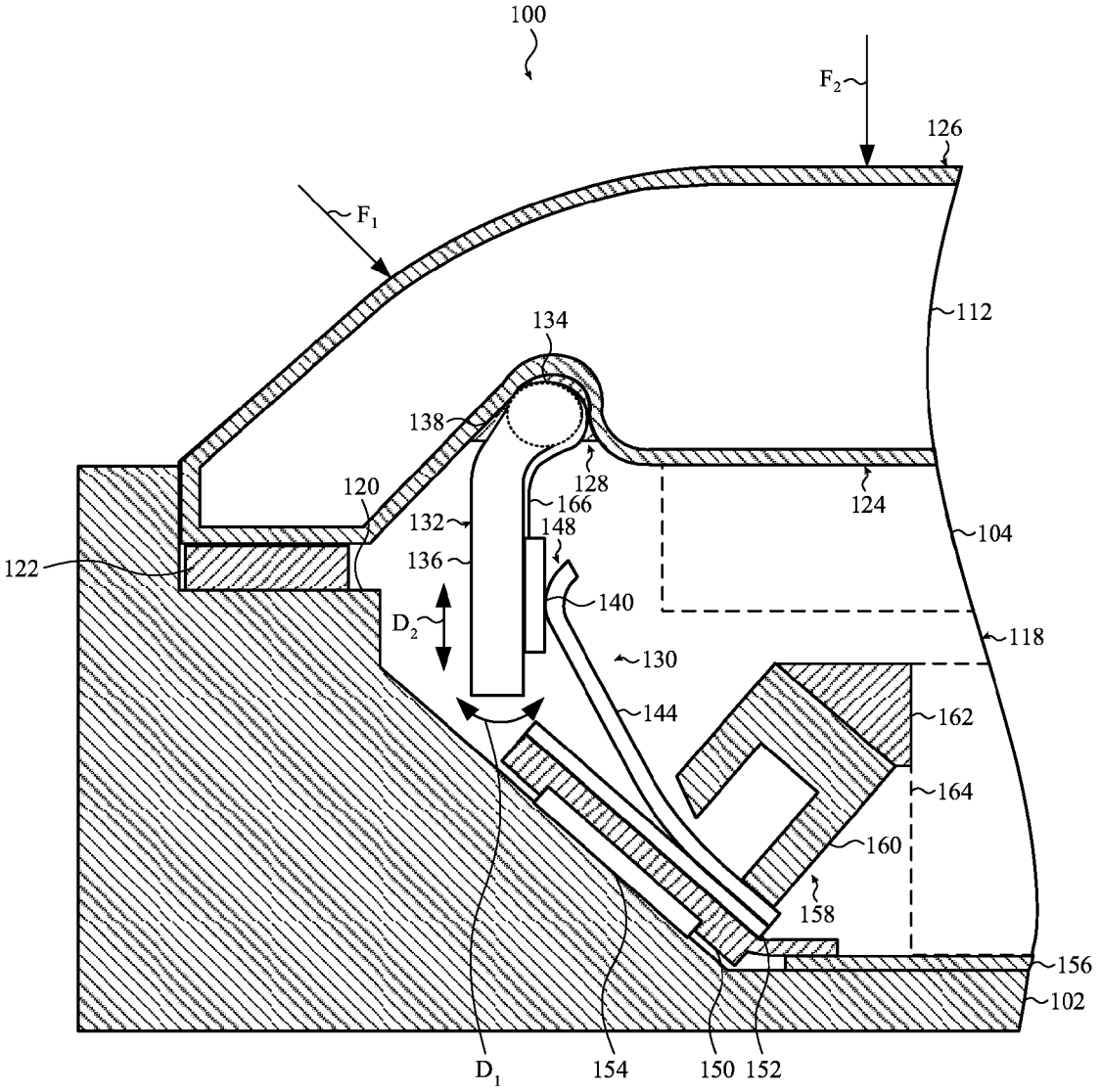
FIG. 2 depicts an enlarged cross-section view of a portion of the electronic device of FIG. 1, taken along line 2-2, according to embodiments.

FIG. 2 depicts an enlarged cross-section front view of a portion of electronic device 100 of FIG. 1 taken along line 2-2, according to an embodiment. With respect to this particular embodiment, FIG. 2 shows a cross-section front view of a portion of housing 102 and cover 112 of electronic device 100. A space or opening 118 may be formed between housing 102 and cover 112; the opening 118 may receive additional components of electronic device 100. More specifically, opening 118 of electronic device 100 may receive and/or may provide space for certain or all internal components of electronic device 100. In the non-limiting example of FIG. 2, display 104 is shown in phantom and may be positioned within at least a portion of opening 118 formed between cover 112 and housing 102.

As discussed herein with respect to FIG. 1, display 104 may be formed from any suitable user-interactive display technology, and may have touch-sensing functionality or may be associated with a touch sensor. Additionally, display 104 may be protected by cover 112 positioned above and/or coupled to display 104 positioned within a portion of opening 118 of electronic device 100. The cover 112 may be transparent or translucent, fully or partially, in certain embodiments.

Cover 112 of electronic device 100 may be formed from a substantially annealed and polished sapphire material. That is, and as discussed herein, cover 112 may be formed from an annealed sapphire material having all or some portions of the surface polished prior to and/or subsequent to the annealing. By annealing the sapphire material, hardness of cover 112 may increase, and/or may also provide a planar surfaces that may be more easily processed and/or may facilitate transparency in the sapphire material forming cover 112. Additionally, the process of annealing the sapphire material may also fill in or seal cracks or other surface defects formed in the sapphire material during processing.

As shown in FIG. 2, cover 112 may be coupled to housing 102. More specifically, a portion of cover 112 may be positioned above and, may be coupled to, a shelf portion 120 formed adjacent a perimeter of housing 102. Shelf portion 120 may be formed substantially around the entire perimeter of housing 102, and may receive and/or couple a portion of cover 112 to housing 102. As shown in FIG. 2, cover 112 may be coupled to shelf portion 120 of housing 102 using an adhesive 122, such as adhesive tape. However it is understood that cover 112 may be coupled to shelf portion 120 of housing 102 using any suitable coupling component or technique. In additional non-limiting examples, cover 112 of electronic device 100 may be coupled to housing 102 using chemical, adhesives, bonding agents, laser welding, melting, and mechanical coupling components (snap-fit structures, detents, screws, and the like).

Cover 112, as shown in FIG. 2, may define an inner surface 124 and an outer surface 126 positioned opposite inner surface 124. Inner surface 124 may be positioned substantially adjacent opening 118 and may not be exposed to a user of electronic device 100. As shown in FIG. 2, and as discussed herein, display 104 (shown in phantom) may be positioned adjacent to and/or may be coupled to inner surface 124. Outer surface 126 may be exposed to, and/or may be contacted by a user of electronic device 100 when the user is interacting with display 104.

As shown in FIG. 2, cover 112 may have a groove 128 formed on inner surface 124. More specifically, groove 128 may be formed on inner surface 124, substantially around the entire perimeter or all four sides of cover 112. Groove 128 may be formed partially through a portion of cover 112. Groove 128, as shown in FIG. 2, may be formed in cover 112 using a plurality of processes including laser-cutting groove 128 on inner surface 124, and subsequently computer numerical control (CNC) machining the laser cut groove 128 formed in cover 112.

Groove 128 may be formed in cover 112 for a variety of functions. In a non-limiting example, groove 128 may be formed in cover 112 to provide additional space within electronic device 100 for additional components. In the non-limiting example, groove 128 may receive and/or may house an antenna (see, FIG. 2) of electronic device 100, such that the antenna may be positioned, fully or partially, within groove 128 of cover 112, optionally without occupying any space within opening 118 of electronic device 100. The antenna may be used to share (e.g., send and/or receive) data collected and/or determined by the electronic device 100. In another non-limiting example, groove 128 may provide a coupling surface for display 104, where a portion of display 104 may be positioned within and/or coupled to groove 128 to position display 104 adjacent inner surface 124 of cover 112.

As shown in FIG. 2, electronic device 100 may also include signal transmission system 130 positioned within housing 102 of electronic device 100. Signal transmission system 130 may include components configured to transmit and/or received data for electronic device 100. Signal transmission system 130, as shown in FIG. 2, may include an antenna 132 coupled to cover 112, where antenna 132 is at least partially positioned within groove 128 of cover 112. Antenna 132 or the antenna body, as shown in FIG. 2, may be formed from a substantially circular loop portion 134 (hereafter, "loop portion 134") positioned within groove 128, and at least one flexible protrusion 136 extending from loop portion 134. As discussed herein, loop portion 134 of antenna 132 may be positioned throughout and extend the length of groove 128 formed adjacent to the entire perimeter of cover 112. Additionally, as discussed herein, flexible protrusion 136 may extend from a portion of loop portion 134 positioned within groove 128.

Loop portion 134 may include a substantially tubular or circular geometry, and may include an outer geometry that may at least partially correspond to groove 128 of housing 102. That is, and as shown in FIG. 2, loop portion 134 may include a rounded exterior surface or geometry, and at least a portion of loop portion 134 of antenna 132 may substantially correspond with the curved interior surface 124 of groove 128. By including a substantially rounded exterior surface in loop portion 134, loop portion 134 of antenna 132 may nest or fit within groove 128 with minimal tolerance between the respective surfaces of the components. Additionally, by including a substantially rounded exterior surface in loop portion 134, loop portion 134 of antenna 132 may be coupled to groove 128 without requiring a large amount of adhesive or bonding agent. That is, where loop portion 134 is coupled to groove 128 using adhesive 138, the reduced tolerance between loop portion 134 and groove 128 may reduce the amount of adhesive 138 used for coupling loop portion 134 to groove 128, without affecting the strength of the bond formed between the two.

Flexible protrusion 136 of antenna 132 may extend into housing 102 of electronic device 100. More specifically, as shown in FIG. 2, flexible protrusion 136 may extend from loop portion 134 and/or another portion of antenna 132, that is positioned within groove 128 of cover 112 into opening 118 of housing 102. Flexible protrusion 136 of antenna 132 may be suspended within housing 102 of electronic device 100 without additional structure support. As discussed herein, this may allow flexible protrusion 136 to flex, move and/or deform when a user applies a force to cover 112 to interaction with display 104 of electronic device 100.

Loop portion 134 and flexible protrusion 136 of antenna 132 may be formed from any suitable material that may allow signal transmission system to transmit and/or receive data using radio frequencies. In non-limiting examples, antenna 132, and specifically loop portion 134 and flexible protrusion 136, may be formed from any suitable conductive metal. Additionally, antenna 132 may be pre-formed prior to being positioned within groove 128 of cover 112, or alternatively, may be formed within groove 128 of cover 112 using any suitable manufacturing technique or process. In a non-limiting example, as shown in FIG. 2, loop portion 134 and flexible protrusion 136 of antenna 132 may be integrally from a single electrically conductive material. In another non-limiting example, loop portion 134 and flexible protrusion 136 may be formed from two distinct, coupled components that may be in electronic communication with one another.

Antenna 132 may also include at least two contact pads 140, 142 positioned on flexible protrusion 136. In a non-limiting example, two contact pads 140, 142 may be positioned on flexible protrusion 136, and may be in electrical communication with antenna 132 via flexible protrusion 136. Each of the contact pads 140, 142 may correspond to distinct signal paths for antenna 132 of signal transmission system 130. Specifically, and as shown in FIG. 2, first contact pad 140 of antenna 132 may correspond to a feed path or antenna path for antenna 132. Additionally, second contact pad 142 (see, FIGS. 3 and 4) may correspond to a short path or ground path for antenna 132.

Signal transmission system 130 of electronic device 100 may also include at least two flexible members 144, 146 positioned adjacent flexible protrusion 136. More specifically, signal transmission system 130 may include flexible members 144, 146 positioned within housing 102 of electronic device 100, adjacent flexible protrusion 136, and in contact with respective contact pads 140, 142 of antenna 132. As shown in FIG. 2, flexible members 144, 146 (one shown) may contact and/or touch contact pads 140, 142 to place flexible members 144, 146 in electronic communication with antenna 132. That is, by contacting contact pads 140, 142 of antenna 132, flexible members 144, 146 may be in electronic communication with antenna 132 via contact pads 140, 142. First flexible member 144 may contact first contact pad 140 of antenna 132, and second flexible member 146 (see, FIGS. 3 and 4) may contact second contact pad 142. As such, and similar to contact pads 140, 142 of antenna 132, each flexible member 144, 146 may correspond to a distinct signal path for antenna 132 of signal transmission system 130.

Flexible members 144, 146 may be formed from a similar conductive material as antenna 132 for transmitting a signal from antenna 132 to a circuit component, as discussed herein. Additionally, in another non-limiting embodiment, flexible members 144, 146 may be formed from a flexible circuit board. Like flexible protrusion 136 of antenna 132, flexible members 144, 146 may be formed from a material having flexible characteristics or traits. As shown in FIG. 2, flexible members 144, 146 may be substantially flexed or bent when contacting contact pads 140, 142 of antenna 132. The flexible characteristics of flexible members 144, 146 may maintain a contact and/or electronic communication between contact pads 140, 142 and flexible members 144, 146 to transmit and/or receive data through antenna 132 of electronic device 100.

Additionally, as a result of flexible protrusion 136 extending from loop portion 134 and having no additional structural support, flexible protrusions 136 may move when a force ($F_1$) is applied to cover 112. That is, when a user of electronic device 100 applies an angular force ($F_1$) to cover 112 to interaction with display 104, cover 112 may be slightly displaced and/or may be slightly deformed. As a result, flexible protrusions 136 may move with cover 112. Specifically, flexible protrusion 136 may move in a direction ($D_1$) as a result of the movement of cover 112 and the force applied by flexible members 144, 146 to flexible protrusion 136. As flexible protrusions 136 flexes, moves and/or deforms, flexible members 144, 146 may also flex and/or move to maintain the contact between contact pads 140, 142 and flexible members 144, 146, and ultimately maintain an electrical communication between flexible members 144, 146 and antenna 132.

When a force ($F_2$) is applied to cover 112 by a user of electronic device 100, cover 112 may deform, deflect and/or move in a distinct direction ($D_2$). As a result of this deflection or movement of cover 112, antenna 132 coupled to cover 112 may also move in direction ($D_2$). As a result of flexible members' 144, 146 characteristics, and the inclusion of substantially rounded contact surfaces 148, flexible members 144, 146 may slide and still maintain a contact with contact pads 140, 142 as antenna 132 moves in direction ($D_2$). Additionally, flexible members 144, 146 may maintain contact with contact pads 140, 142 when cover 112 moves because flexible members 144, 146 are tensioned biased against flexible protrusion 136 of antenna 132. As discussed herein, by maintaining a contact with contact pads 140, 142, an electrical communication between flexible members 144, 146 and antenna 132 may also be maintained when cover 112 and antenna 132 move in direction ($D_2$) when force ($F_2$) is applied by a user.

As shown in FIG. 2, signal transmission system 130 may also include a flexible electronic layer 150 coupled to, and in electronic communication with flexible members 144, 146. Solder 152 may be provided between flexible members 144, 146 and flexible electronic layer 150 to couple at least a portion of flexible members 144, 146 to flexible electronic layer 150. By only coupling a portion of flexible members 144, 146 to flexible electronic layer 150, flexible members 144, 146 may not be restrained and/or limited when flexing to maintain contact with contact pads 140, 142 of antenna 132, as discussed herein. Additionally, flexible members 144, 146 may be in electronic communication with flexible electronic layer 150, as discussed herein, to form a circuit path between antenna 132 and flexible electronic layer 150. As shown in FIG. 2, flexible electronic layer 150 may also be coupled to housing 102 of electronic device 100. Specifically, a conductive adhesive 154 may be used to couple flexible electronic layer 150 to housing 102 of electronic device 100 to provide a ground path for antenna 132. Conductive adhesive 154 may be any suitable material that may secure flexible electronic layer 150 to housing 102, and aid in the electronic transmission of signals between flexible members 144, 146 and flexible electronic layer 150.

In a non-limiting example, as shown in FIG. 2, flexible electronic layer 150 may be a "ribbon" or an electronic gateway in electronic communication with a main logic circuit board 156 of electronic device 100. In the non-limiting example, flexible electronic layer 150 may act as an intermediate component for relaying signals and data to and/or from antenna 132 to main logic circuit board 156 of electronic device 100. In another non-limiting example, flexible electronic layer 150 may include a stand-alone flexible circuit board that may be in direct electronic communication with flexible members 144, 146 for receiving and/or transmitting data using antenna 132.

Signal transmission system 130 may also include a tiebar 158 contacting flexible members 144, 146. As shown in FIG. 2, tiebar 158 may be positioned opposite flexible electronic layer 150, and may be positioned adjacent to and, may contact flexible members 144, 146. Tiebar 158 may completely contact or partially contact flexible members 144, 146 dependent upon the position or flex of flexible members 144, 146 and/or flexible protrusion 136 of antenna 132 within housing 102. Tiebar 158 may be formed from a support portion 160 and a securing portion 162 coupled to support portion 160. In some embodiments, support portion 160 of tiebar 158 may directly contact flexible members 144, 146 and may provide additional support and/or engage flexion points of flexible members 144, 146 when flexible members 144, 146 flexes to maintain contact with contact pads 140, 142 of antenna 132. Securing portion 162 coupled to support portion 160 may secure and/or fix tiebar 158 within housing 102 of electronic device 100. That is, securing portion 162 may be substantially rigid, and may be coupled to housing 102, or an additional component within electronic device 100 to secure or fix tiebar 158 within housing 102. In a non-limiting example, as shown in FIG. 2, securing portion 162 may be coupled to an internal component 164 (shown in phantom) of electronic device 100. Internal component 164 may be any rigid, fixed component of electronic device, for example, internal component 164 may be a battery housing for a battery of electronic device.

Although shown in a specific configuration, tiebar 158 may be formed in distinct configurations within housing 102 of electronic device 100. That is, tiebar 158 may include a variety of geometries and/or configurations for securing flexible members 144, 146 within housing and/or may engage flexion points of flexible members 144, 146 when flexible members 144, 146 flexes to maintain contact with contact pads 140, 142 of antenna 132.

Signal transmission system 130 may also include an insulating layer 166. As shown in FIG. 2, insulating layer 166 may be positioned adjacent antenna 132 and contact pads 140, 142. More specifically, insulating layer 166 may be formed over loop portion 134 and flexible protrusion 136, adjacent opening 118 of housing 102 of electronic device 100. Additionally, insulating layer 166 may at least partially surround and/or may be formed adjacent contact pads 140, 142 that are formed on flexible protrusions 136 of antenna 132. Insulating layer 166 may be formed adjacent opening 118 of housing 102 to substantially block or prevent signals from antenna 132 from leaking into opening 118 and interfering with other electrical components therein.

Additionally, insulating material may reduce or prevent emitted signals from distinct components of electronic device 100 positioned within opening 118 from interfering with the signals emitted by antenna 132. As a result of forming insulating layer 166 only on a portion of antenna 132, and because the material forming cover 112 does not substantially interfere with radio frequency (RF) signals, antenna 132 may still emit signals through cover 112 without substantial interference. Insulating layer 166 may be formed from any suitable material that may substantially block radio frequency signals.

Figure 3:
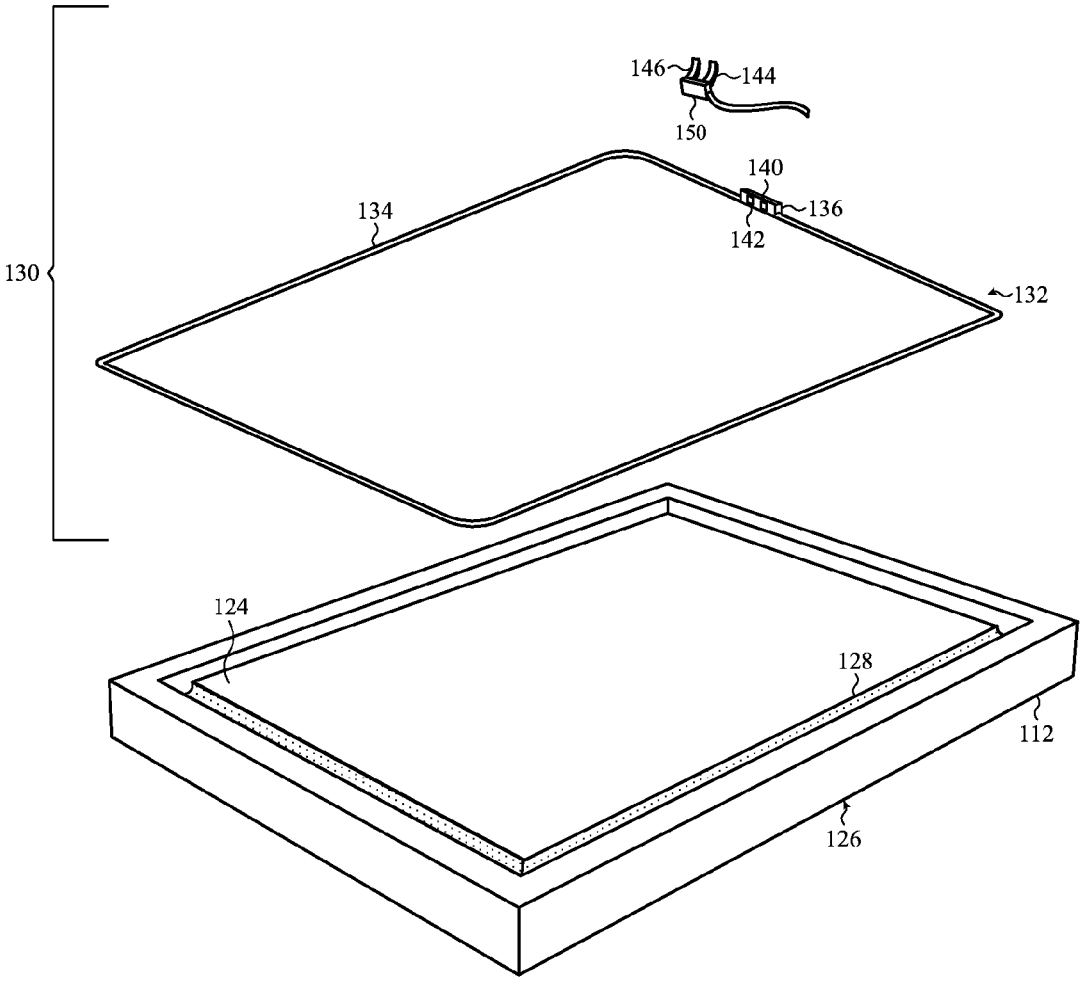
FIG. 3 depicts an illustrative perspective view of a cover and a signal transmission system of an electronic device of FIG. 2, according to embodiments.
Figure 4:
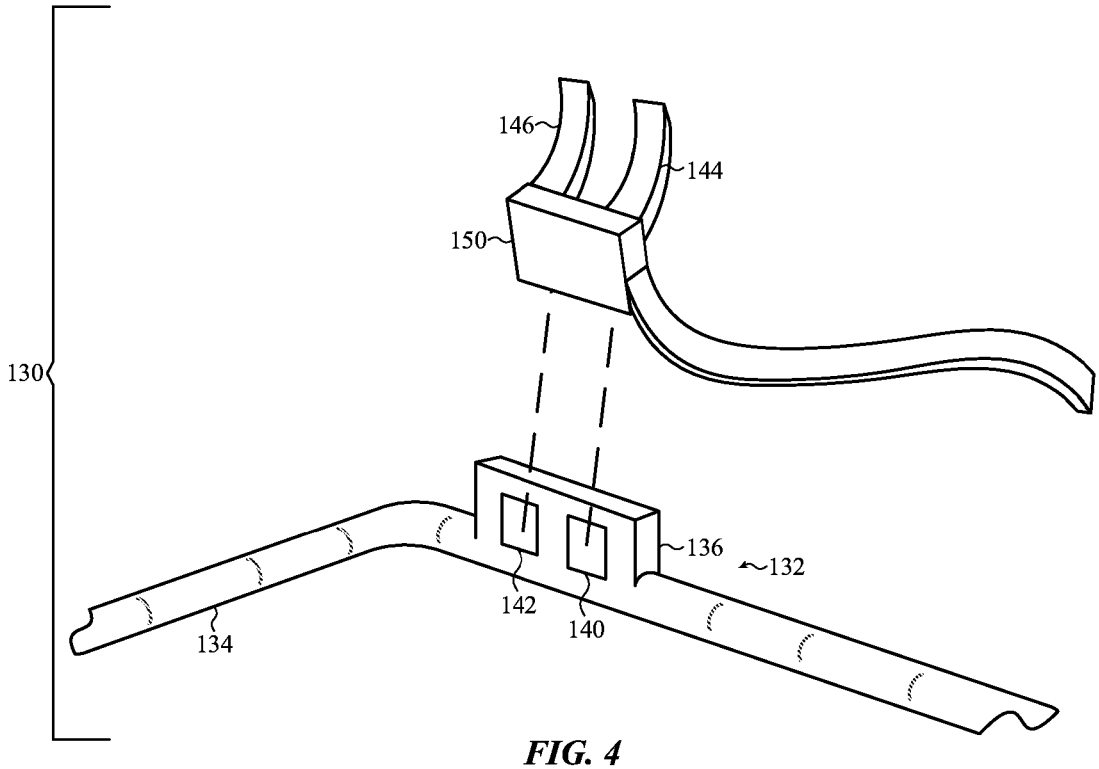
FIG. 4 depicts an illustrative isometric view of a portion of the signal transmission system of FIGS. 2 and 3, according to embodiments.

FIGS. 3 and 4 show an illustrative perspective view of cover 112 (FIG. 3) and a portion of signal transmission system 130 of electronic device 100 of FIG. 2. It is understood that similarly named components or similarly numbered components may function in a substantially similar fashion, may include similar materials and/or may include similar interactions with other components. Redundant explanation of these components has been omitted for clarity.

As shown in FIG. 3, groove 128 may be formed in inner surface 124, about some or all four sides of cover 112. Additionally, as shown in FIG. 3, antenna 132 may be positioned within and/or may substantially fill substantially all of groove 128 formed in cover 112. Antenna 132, and specifically, loop portion 134 (see, FIG. 2) may be positioned completely within groove 128 around all four sides of cover 112, such that only flexible protrusion 136 may protrude or extend beyond inner surface 124 of cover 112. By forming groove 128 within cover 112, and subsequently positioning antenna 132 within groove 128, antenna 132 of signal transmission system 130 may require only the space in opening 118 occupied by flexible protrusion 136. This may provide added space within opening 118 for additional internal components of electronic device 100. Furthermore, the added space within opening 118 may allow housing 102, and ultimately electronic device 100, to be reduced in size.

As shown in FIG. 4, and discussed herein with respect to FIG. 2, first flexible member 144 may contact first contact pad 140 positioned on flexible protrusion 136 of antenna 132. Additionally, second flexible member 146 may contact second contact pad 142 of antenna 132. First flexible member 144 and second flexible member 146 may also be coupled to and in electronic communication with flexible electronic layer 150 for forming an electrical path between antenna 132 and flexible electronic layer 150.

Figure 5:
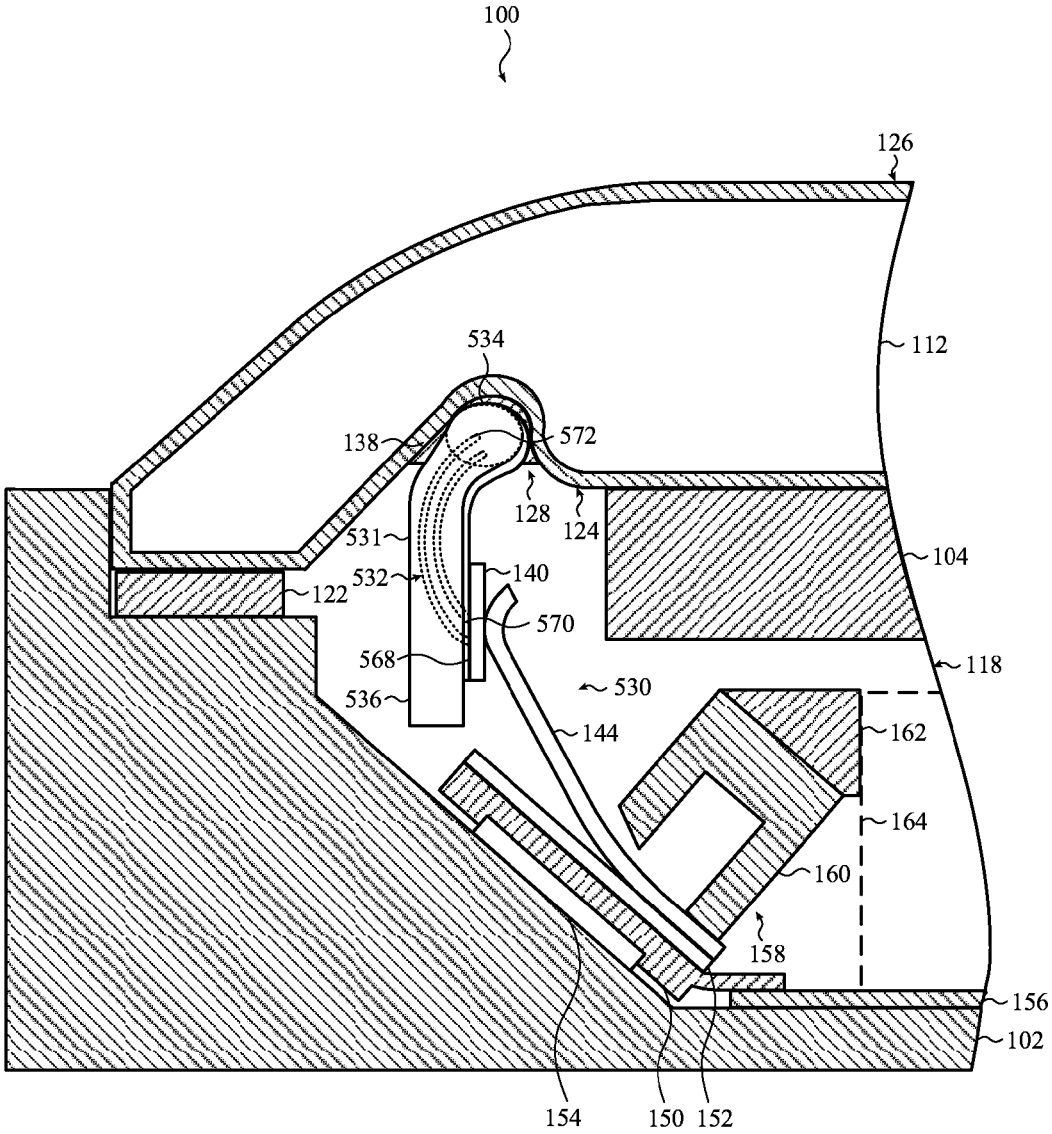
FIG. 5 depicts an enlarged cross-section view of a portion of the electronic device of FIG. 1, taken along line 2-2, according to various embodiments. The electronic device includes a signal transmission system having a single-wrapped antenna wire.
Figure 6:
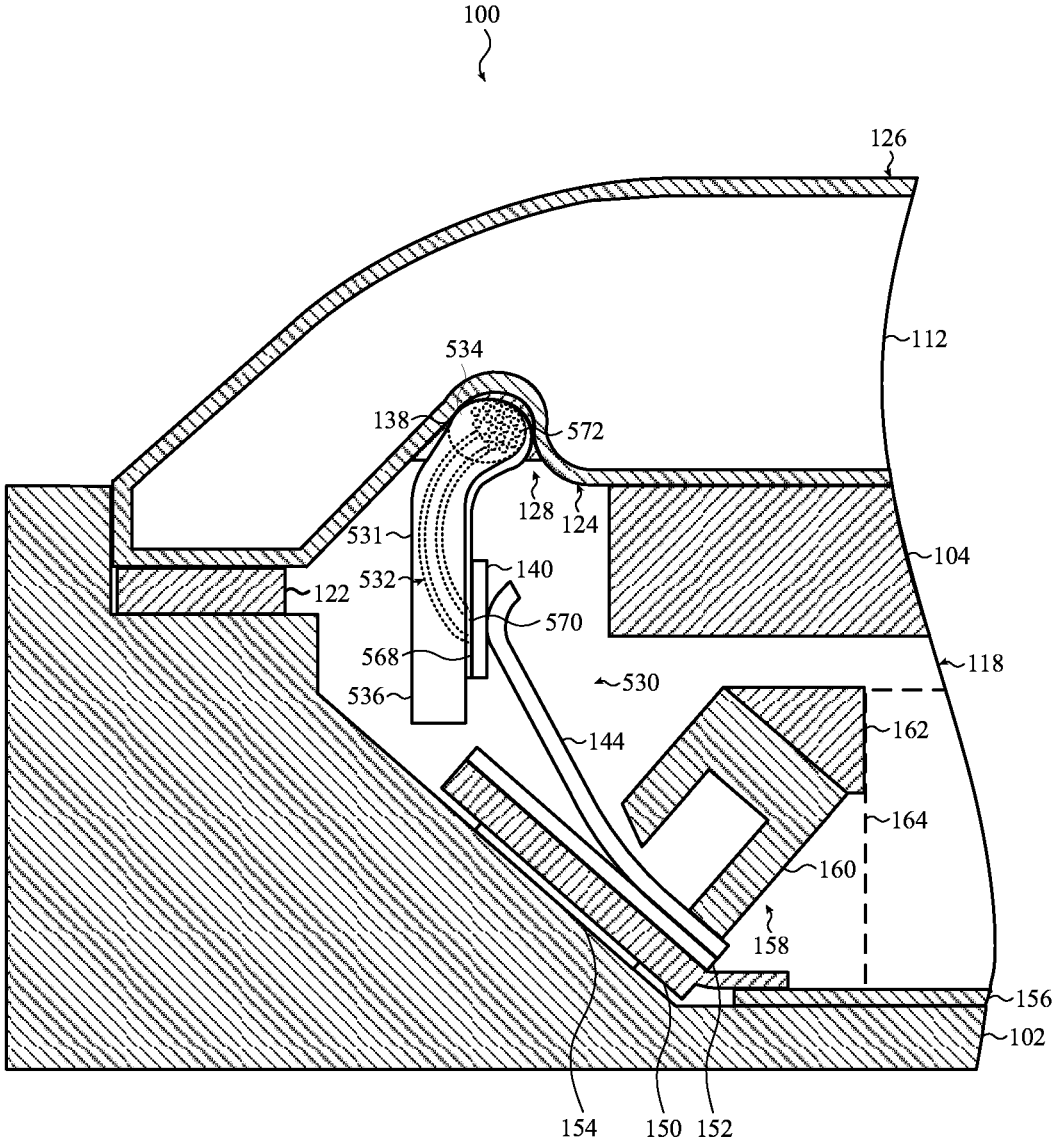
FIG. 6 depicts an enlarged cross-section view of a portion of the electronic device of FIG. 1, taken along line 2-2, according to additional embodiments. The electronic device includes a signal transmission system having a multiple-wrapped antenna wire.

FIGS. 5 and 6 depict enlarged cross-section front views of a portion of electronic device 100 of FIG. 1 taken along line 2-2, according to various embodiments. Specifically, FIGS. 5 and 6 show electronic device 100 of FIG. 1 including a distinct signal transmission system 530 from signal transmission system 130 discussed herein with respect to FIGS. 2-4. It is understood that similarly named components or similarly numbered components may function in a substantially similar fashion, may include similar materials and/or may include similar interactions with other components. Redundant explanation of these components has been omitted for clarity.

As shown in FIGS. 5 and 6, signal transmission system 530 may include a distinct configuration and/or distinct components for operation than signal transmission system 130 discussed herein. More specifically, signal transmission system 530 may include an antenna housing 531. Antenna housing 531 may be formed from any suitable material that may form a protective housing for an antenna wire of signal transmission system 530, as discussed herein. In an non-limiting example, antenna housing 531 may be formed from a cast polymer material. Antenna housing 531 may include a substantially circular loop portion 534 (hereafter, "loop portion 534"), and a flexible protrusion 536 extending from loop portion 534. Loop portion 534 of antenna housing 531 may be positioned within groove 128 of cover 112, and flexible protrusion 536 may extend from loop portion 534 into housing 102 of electronic device 100. Additionally, loop portion 534 and flexible protrusion 536 of antenna housing 531 may function and/or interact with distinct components, such as cover 112, substantially similar to that loop portion 134 and flexible protrusion 136 of antenna 132 discussed herein with respect to FIG. 2. As such, redundant explanation of these portions of antenna housing 531 may be omitted for clarity.

However, distinct from FIG. 2, antenna housing 531 may not transmit and/or receive signals. Rather, antenna housing 531 may be a protective housing or surrounding for an antenna wire 532 position within antenna housing 531. That is, as shown in FIGS. 5 and 6, antenna wire 532 may formed within and protected by antenna housing 531. In non-limiting examples, antenna wire 532 may be fed through antenna housing 531, or antenna housing 531 may be cast around antenna wire 532 when forming antenna housing 531. Like antenna 132 in FIG. 2, antenna wire 532 may transmit and/or receive data for electronic device 100. As such, antenna wire 532 may be formed from a conductive metal material, similar to the material discussed herein with respect to antenna 132 of FIG. 2.

As shown in FIGS. 5 and 6, antenna wire 532 may have a first end 568 that may be in electronic communication with first contact pad 140 of signal transmission system 530. More specifically, first end 568 of antenna wire 532 may contact first contact pad 140 to put antenna wire 532 in electronic communication with first contact pad 140. As discussed herein, first contact pad 140 and first end 568 of antenna wire 532 may correspond to a feed path or antenna path for antenna wire 532 of signal transmission system 530. As shown in FIGS. 5 and 6, and as discussed herein, first flexible member 144 may contact first contact pad 140, and may be in electronic communication with first end 568 of antenna wire 532 via first contact pad 140.

Antenna wire 532 may also have a second end 570 that may be in electronic communication with second contact pad 142 of signal transmission system 530. More specifically, second end 570 of antenna wire 532 may contact second contact pad 142 (see, FIGS. 3 and 4) to put antenna wire 532 in electronic communication with second contact pad 142. As discussed herein, second contact pad 142 and second end 570 of antenna wire 532 may correspond to a short path or ground path for antenna wire 532 of signal transmission system 530. As shown in FIGS. 5 and 6, and as discussed herein, second flexible member 146 may contact second contact pad 142, and may be in electronic communication with second end 570 of antenna wire 532 via second contact pad 142.

Antenna wire 532 may also have a body portion 572 positioned between first end 568 and second end 570. Specifically, and as shown in FIGS. 5 and 6, body portion 572 may extend between first end 568 and second end 570 of antenna wire 532, and may be positioned substantially within loop portion 534 of antenna housing 531. Body portion 572 may be positioned within loop portion 534 of antenna housing 531 and/or groove 128 of cover 112. Additionally, body portion 572 may be positioned substantially around the perimeter or all four sides of cover 112. In a non-limiting example embodiment, as shown in FIG. 5, body portion 572 of antenna wire 532 may make a single pass in loop portion 534, around the perimeter of cover 112. In an another non-limiting example, as shown in FIG. 6, body portion 572 of antenna wire 532 may make multiple passes around loop portion 534 of antenna housing 531, and may make multiple passes around the perimeter of cover 112.

By forming a groove within the cover of the electronic device, and subsequently positioning the majority of the antenna within the groove, the antenna of the signal transmission system may occupy a minimal amount of space within the housing of the electronic device. Additionally, the signal transmission system may include flexible members for forming electrical connections for the antenna. The flexible members may maintain an electrical connection with the antenna even when the antenna deforms or deflects as a result of a user applying a force to the cover of the electronic device.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

We claim:

1. An electronic device comprising:
- a housing;
- a display;
- a cover over the display and coupled to the housing, wherein a groove is formed on an inner surface and around a portion of a perimeter of the cover; and
- a signal transmission system positioned within the housing, the signal transmission system including:
  - an antenna at least partially received within the groove, the antenna comprising:
    - an antenna body; and
    - a contact pad in electrical communication with the antenna body; and
  - a flexible member positioned adjacent the antenna body and contacting the contact pad of the antenna.

2. The electronic device of claim 1, wherein the flexible member is electrically coupled to the antenna via the contact pad.

3. The electronic device of claim 1 wherein, in response to a mechanical force on the cover, the flexible member is configured to slide on the contact pad of the antenna without losing contact with the contact pad.

4. The electronic device of claim 1, wherein the antenna body further comprises:
- a rounded portion; and
- a flexible protrusion extending from the rounded portion.

5. The electronic device of claim 4, wherein the rounded portion of the antenna body is at least partially positioned within the groove formed in the cover.

6. The electronic device of claim 4, wherein the flexible protrusion of the antenna body is located in an interior space of the electronic device between the cover and the housing.

7. The electronic device of claim 1, wherein the signal transmission system further comprises:
- a tiebar contacting the flexible member to secure the flexible member within the housing.

8. The electronic device of claim 7, wherein the tiebar further comprises:
- a support portion contacting the flexible member; and
- a securing portion coupled to the support portion, the securing portion for securing the tiebar within the housing.

9. The electronic device of claim 1, wherein the signal transmission system further comprises:
- a flexible electronic layer coupled to and in electrical communication with the flexible member.

10. The electronic device of claim 9, wherein the flexible electronic layer is coupled to the housing using a conductive adhesive to form a ground for the antenna.

11. The electronic device of claim 9, wherein at least a portion of the flexible member is soldered to the flexible electronic layer.

12. The electronic device defined in claim 2, wherein the antenna further comprises an additional contact pad that is electrically coupled to the antenna body.

13. The electronic device defined in claim 12, further comprising:
- an additional flexible member electrically coupled to the antenna via the additional contact pad.

14. The electronic device defined in claim 13, further comprising:
- a flexible circuit coupled to the flexible member and the additional flexible member, wherein the flexible circuit, the flexible member, and the additional flexible member are configured to convey signals for the antenna.

15. The electronic device defined in claim 14, further comprising:
- a logic board, wherein the flexible circuit is coupled to the logic board; and
- adhesive that affixes the flexible circuit to the housing.

16. The electronic device defined in claim 1, wherein the housing has first and second sides, the groove comprises a first portion that extends along the first side and a second portion that extends along the second side, and at least some of the antenna is formed within the first and second portions of the groove.

17. A signal transmission system for an electronic device, the system comprising:

an antenna including:

a rounded portion;

a single flexible protrusion extending from the rounded portion; and a plurality of contact pads positioned on the single flexible protrusion, wherein the plurality of contact pads are electrically coupled to the antenna; and a plurality of flexible members contacting the plurality of contact pads.

18. The system of claim 17 further comprising an insulating layer positioned between the antenna and the plurality of contact pads positioned on the flexible protrusion.

19. The system of claim 17, wherein the rounded portion of the antenna is positioned within a groove formed in a surface of a cover for the electronic device.

20. The system of claim 19, wherein the cover is formed over a display for the electronic device.

* * * * *